US005198320A

United States Patent [19]

Vreeland et al.

[11] Patent Number: 5,198,320

[45] Date of Patent: Mar. 30, 1993

[54] ELECTROSTATOGRAPHIC TONER COMPRISING BINDER POLYMER CONTAINING CHARGE-CONTROL MOIETIES AND THEIR PREPARATION

[75] Inventors: William B. Vreeland, Webster; Dinesh Tyagi, Fairport; Zona R. Pierce, Rochester, all of N.Y.

[73] Assignee: Eastman Kodak Company, Rochester, N.Y.

[21] Appl. No.: 814,152

[22] Filed: Dec. 30, 1991

[51] Int. Cl.[5] ..... G03G 9/097

[52] U.S. Cl. ..... 430/110

[58] Field of Search ..... 430/110

[56] References Cited

U.S. PATENT DOCUMENTS

| | | | |
|---|---|---|---|
| 4,299,903 | 11/1981 | AuClair et al. | 430/137 |
| 4,652,508 | 3/1987 | Ober et al. | 430/110 X |
| 4,794,065 | 12/1988 | Hedvall et al. | 430/111 |
| 4,797,339 | 1/1989 | Marayama et al. | 430/109 |
| 4,828,954 | 5/1989 | Hashimoto et al. | 430/110 |
| 4,833,060 | 5/1989 | Nair et al. | 430/137 |
| 4,937,167 | 6/1990 | Moffat et al. | 430/110 X |
| 4,965,131 | 10/1990 | Nair et al. | 428/407 |
| 5,037,717 | 8/1991 | Ishii et al. | 430/110 |

FOREIGN PATENT DOCUMENTS

| | | | |
|---|---|---|---|
| 62-10654 | 1/1987 | Japan | 430/137 |
| 1583564 | 8/1976 | United Kingdom | 430/137 |

*Primary Examiner*—Roland Martin

*Attorney, Agent, or Firm*—Willard G. Montgomery

[57] ABSTRACT

Electrostatographic toners and developers, containing binder polymers that also function as charge agents are disclosed. The toner is prepared by a limited coalescence process and comprises binder polymer particles that have a surface layer of smaller polymeric stabilizer particles that are covalently bonded through a plurality of oxygen linkages to a polyorganosiloxane oligomer containing pendant charge-control moieties.

7 Claims, No Drawings

ELECTROSTATOGRAPHIC TONER COMPRISING BINDER POLYMER CONTAINING CHARGE-CONTROL MOIETIES AND THEIR PREPARATION

FIELD OF THE INVENTION

This invention relates to electrostatographic toner comprising binder polymer particles. More particularly, the invention concerns toner comprising binder polymer particles that have a surface layer of small polymeric particles that are covalently bonded through a plurality of oxygen linkages to a polysiloxane oligomer containing pendant charge-agent moieties. The particles serve the dual function of binder polymer and charge agent in the inventive electrostatographic toner. The invention also pertains to the method of making such electrostatographic toner by a limited coalescence process.

BACKGROUND

In electrostatography an image comprising an electrostatic field pattern, usually of non-uniform strength, (also referred to as an electrostatic latent image) is formed on an insulative surface of an electrostatographic element by any of various methods. For example, the electrostatic latent image may be formed electrophotographically (i.e., by image wise photo-induced dissipation of the strength of portions of an electrostatic field of uniform strength previously formed on a surface of an electrophotographic element comprising a photoconductive layer and an electrically conductive substrate), or it may be formed by dielectric recording (i.e., by direct electrical formation of an electrostatic field pattern on a surface of a dielectric material). Typically, the electrostatic latent image is then developed into a toner image by contacting the latent image with an electrostatographic developer. If desired, the latent image can be transferred to another surface before development.

One well-known type of electrostatographic developer comprises a dry mixture of toner particles and carrier particles. Developers of this type are commonly employed in well-known electrostatographic development processes such as cascade development and magnetic brush development. The particles in such developers are formulated such that the toner particles and carrier particles occupy different positions in the triboelectric continuum, so that when they contact each other during mixing to form the developer, they become triboelectrically charged, with the toner particles acquiring a charge of one polarity and the carrier particles acquiring a charge of the opposite polarity. These opposite charges attract each other such that the toner particles cling to the surfaces of the carrier particles. When the developer is brought into contact with the latent electrostatic image, the electrostatic forces of the latent image (sometimes in combination with an additional applied field) attract the toner particles, and the toner particles are pulled away from the carrier particles and become electrostatically attached imagewise to the latent image-bearing surface. The resultant toner image can then be fixed in place on the surface by application of heat or other known methods (depending upon the nature of the surface and of the toner image) or can be transferred to another surface, to which it then can be similarly fixed.

Many well-known types of toner useful in dry developers comprise binder polymer materials such as vinyl addition polymers or condensation polymers. Such binder polymers are chosen for their good combinations of advantageous properties, such as toughness, transparency, good adhesion to substrates, and fusing characteristics, such as the ability to be fixed to paper at relatively low fusing temperatures while not permanently adhering to fusing rolls, except at relatively high temperatures. As is well-known, vinyl addition polymers that are useful as binder polymers in toner particles can be linear, branched or lightly crosslinked. The most widely used condensation polymers are polyesters which are polymers in which backbone recurring units are connected by ester linkages. Like the vinyl addition polymers, polyesters useful as binder materials in toner particles can be linear, branched, or lightly crosslinked. They can be fashioned from any of many different monomers, typically by polycondensation of monomers containing two or more carboxylic acid groups (or derivatives thereof, such as anhydride or ester groups) with monomers containing two or more hydroxy groups.

While many binder polymers exhibit many desirable properties for use in electrostatographic toners, they do have certain shortcomings. For example, binder polymers are commonly ground to a small particle size to provide the high degree of resolution required in good quality copies. Accordingly, such polymers are desirably very brittle which provides a high degree of grindability. Unfortunately, many polymers, and especially polyesters which are otherwise useful for toners are not sufficiently easily ground to the very small particle sizes needed for high-resolution toners. To overcome this problem, methods have been developed which directly provide binder polymers having a controlled and predetermined size and size distribution suitable for use in electrostatographic toners. One such method is a polymer suspension technique which is known in the prior art as a "limited coalescence" process, as described in U.S. Pat. No. 4,833,060, issued May 23, 1989 and U.S. Pat. No. 4,965,131, issued Oct. 23, 1990.

In the limited coalescence process described in the aforementioned patents, binder polymer particles are prepared by forming a solution of a suitable polymer in a solvent that is immiscible with water, dispersing the polymer solvent solution in an aqueous medium containing small particles of a solid stabilizer to form droplets of polymer solvent solution (oil phase) in the aqueous medium (aqueous phase), removing the solvent and recovering binder polymer particles. During the course of the process, coalescence of the oil (discontinuous) phase takes place to form larger size droplets. These droplets are limited in size by the presence of the particles of the solid stabilizer (often referred to as a suspension stabilizing agent) in the aqueous (continuous) phase. The solid stabilizer particles limit coalescence from taking place by a mechanism that is generally believed to be a physical phenomenon of preventing, by separation, one droplet from wetting another and thereby joining together to form a larger droplet. Removal of the solvent from the droplets provides solid binder polymer particles that are covered with a layer of smaller stabilizer particles.

In the limited coalescence process described in U.S. Pat. No. 4,833,060 the solid stabilizer particles are silica particles which are removed from the binder polymer particles that are used in an electrostatographic toner.

This is necessary because the presence of stabilizer particles such as silica interfere with the triboelectric relationship between carrier particles and toner particles employed in developers in electrostatographic copying devices.

U.S. Pat. No. 4,965,131 represents a significant improvement in making binder polymer particles by limited coalesence-type processes in that polymeric stabilizer particles are employed by the patentees and such stabilizer particles need not be removed from the surfaces of the binder polymer particles. Accordingly, this process avoids the lengthy and generally costly techniques that are normally necessary to remove stabilizer particles such as silica from binder polymer particles intended for use in electrostatographic toners. Other significant advantages of substituting polymeric stabilizer particles for inorganic stabilizer particles such as silica in a limited coalescence process are described in U.S. Pat. No. 4,965,131.

It is also known that electrostatographic toners used in dry developers often contain material referred to as a charge agent or charge-control agent, which helps to establish and maintain toner charge within an acceptable range. Many types of charge-control agents have been used and are described in the published patent literature. Unfortunately, many of the known charge-control agents exhibit significant drawbacks when used with binder polymer particles, particularly those prepared in a limited coalescence-type process. For example, such charge agents often fail to provide sufficient initial charge or to maintain such charge for adequate development. A lack of satisfactory charge-control can significantly and detrimentally affect the life of an electrostatographic developer.

It would therefore, be desirable to provide a limited coalescence process for preparing binder polymer particles exhibiting adequate electrostatographic charge-control characteristics. Likewise, it would be desirable to provide electrostatographic toners comprising such binder polymer particles. The present invention meets such objectives.

SUMMARY OF THE INVENTION

This invention provides a limited coalescence process for preparing binder polymer particles using polymeric stabilizer particles that provide a plurality of bonding sites on the surfaces of the polymer particles and reacting such sites with a plurality of hydroxy groups in a polyorganosilane oligomer that contains pendant charge-control moieties. Accordingly, this invention provides an improvement in the method of making electrostatographic toner comprising binder polymer particles and electrostatographic charge-control moieties by suspending in an aqueous medium, droplets of binder polymer dissolved in a solvent immiscible with water, in the presence of smaller solid polymeric stabilizer particles that limit coalescence among the droplets, removing solvent from the droplets to form solid polymer binder particles having a layer of smaller polymeric stabilizer particles on their surfaces, and incorporating charge-control agents containing electrostatographic charge-control moieties into the binder polymer particles. Such improvement comprises (a) suspending the droplets of the binder polymer in the presence of polymeric stabilizer particles that form a layer containing a plurality of bonding sites on the surfaces of the polymer binder particles and (b), reacting such sites with a polyorganosiloxane oligomer that contains a plurality of hydroxy groups and pendant charge-control moieties and is capable of forming covalent bonds between such hydroxy groups and such sites, to thereby covalently and pendently bond the charge-control moieties to the binder polymer particles through a plurality of oxygen linkages between the polymeric stabilizer particles and the polyorganosiloxane oligomer.

This invention also provides an electrostatographic toner comprising binder polymer particles prepared using the aforementioned process. Such electrostatographic toner comprises binder polymer particles and charge-control moieties wherein the binder polymer particles have a surface layer of smaller polymeric particles that are covalently bonded through a plurality of oxygen linkages to a polyorganosiloxane oligomer containing pendant charge-control moieties.

This invention also provides a dry electrostatographic developer comprising carrier particles and particles of the toner described in the previous paragraph.

The use of the polyorganosiloxane oligomer according to the process of this invention provides ideal placement of the charge-control moieties on the surface of the toner particles and results in a toner that exhibits an excellent combination of properties and, in particular, exceptional charge stability. Accordingly, electrostatographic developers containing such toners exhibit excellent developer life. Also, the ability to select the concentration and nature of the electrostatographic charge-control moieties present in the polyorganosiloxane oligomer provides flexibility in determining both the intensity and polarity of the charge on toner particles prepared by this invention. In addition, the surfaces of the polymer particles exhibit many of the properties of the polyorganosiloxane oligomer which can improve the flow properties of the toner particles as well as their sensitivity to changes in environmental relative humidity and/or temperature, which changes often lead to erratic performance of electrostatographic charge-control agents under changing environmental conditions. Other significant advantages of this invention will become evident from the description that follows.

DETAILED DESCRIPTION OF THE INVENTION

In the method of this invention, small solid stabilizer particles are used to limit the coalescence of suspended droplets formed from binder polymers dissolved in a solvent. Additional details of this type of process can be found in U.S. Pat. No. 4,833,060, issued May 23, 1989 and U.S. Pat. No. 4,965,131, issued Oct. 23, 1990, referenced earlier, which are herein incorporated by reference. Like U.S. Pat. No. 4,965,131, the stabilizer particles used in this invention are polymeric stabilizer particles rather than silica, as described in U.S. Pat. No. 4,833,060, but the process parameters of each of these patents are relevant to this invention.

An essential feature of this invention is the use in the process of small polymeric stabilizer particles (generally colloidal in size) that adhere to the surface of the binder polymer particles and provide a layer that has active sites, e.g. carboxy (—COOH) or hydroxy (-OH) groups, that are capable of reacting with the plurality of hydroxy groups in the polyorganosiloxane oligomer to provide a plurality of oxygen linkages between the polymeric stabilizer particles and the polyorganosiloxane oligomer. Any polymeric stabilizer particles that are capable of limiting the coalescence of the binder polymer particles during the process and of providing a layer having such active sites can be employed in the practice of this invention. A suitable class of stabilizers is described in U.S. Pat. No. 4,965,131 and comprises copolymers of at least three different addition polymerizable monomers; typically about 25 to 80%, by weight, of a nonionic oleophilic monomer, about 5 to 45%, by weight of a nonionic hydrophilic monomer, about 1 to 50% by weight, of an ionic monomer, and 0 to about 20%, by weight of a cross-linking monomer having at least two addition polymerizable groups (all weights based on total monomer weight) The monomers used in forming such polymeric stabilizers are addition polymerizable and include monomers containing ethylenic unsaturation or more specifically vinylic, acrylic and/or allylic groups. Examples of suitable nonionic oleophilic monomers include, n-butyl acrylate, benzyl acrylate, t-butyl methacrylate, benzyl methacrylate, m- and p-chlorometylstyrene, 2-chloroethyl methacrylate, ethyl methacrylate, 2-ethylhexyl methacrylate, n-butyl methacrylate, isopropyl methacrylate, lauryl acrylate, methyl methacrylate, 2-ethoxyethyl acrylate, 2-phenyl acrylate, n-propyl methacrylate, n-hexyl acrylate, styrene, p-t-butylstyrene, vinyl acetate, vinyl bromide, vinyl chloride, m- and p-vinyltoluene, and vinyl benzoate.

Examples of nonionic hydrophilic monomers that are useful for making suitable polymeric stabilizer include, for example, acrylamide, allyl alcohol, n-(isobutoxymethyl)acrylamide. 2-poly(ethyleneoxy)ethyl acrylate, methacryloxypolyglycerol, 2-hydroxyethyl acrylate, 2-hydroxypropyl acrylate, n-isopropylacrylamide, 2-hydroxyethyl methacrylate, acrylonitrile, methacrylonitrile, 2-hydroxypropyl methacrylate, p-aminostyrene, N,N-dimethylmethacrylamide, N-methylacrylamide, 2-methyl-5-vinyl-pyridine, 4-vinylpyridine, N-isopropyl-methacrylamide, N,N-dimethylacrylamide, 2-(dimethylamino)ethyl acrylate, and 2-(diethylamino)ethyl methacrylate.

Suitable ionic monomers that can be used for making the polymeric stabilizer include both anionic and cationic monomers that dissociate in water at the pH at which the copolymer is prepared Examples of such anionic monomers are acrylic acid, methacrylic acid, fumaric acid, itaconic acid, maleic acid, pyridinium 2-methacryloyloxyethylsulfate, 3-acrylamidopropane-1-sulfonic acid, potassium salt, p-styrenesulfonic acid, sodium salt, 2-acrylamido-2-methylpropanesulfonic acid, methacrylic acid, sodium salt, lithium methacrylate,2-methacryloyloxyethyl-1-sulfonic acid ammonium p-styrenesulfonate, and sodium o- and p-styrenesulfonate. Examples of suitable cationic monomers include, for example, N-(3-acrylamidopropyl)ammonium methacrylate. N-(2-methacryloloxyethyl)-N,N,N-trimethylammonium iodide, 1,2-dimethyl-5-vinylpyridinium methosulfate, N-(2methacryloyloxethyl)-N,N,N-trimethyulammonium bromide, N-vinylbenzyl-N,N,N-trimethylammonium chloride, 3-methyl-1-vinylimidazolium methosulfate, and N-(3-methacrylamidopropyl-N,N,N-trimethylammonium chloride.

Suitable crosslinking monomers include, for example, N,N'-methylenebisacrylamide, ethylene dimethacrylate, 2,2-dimethyl-1,3-propylene diacrylate, divinylbenzene, 4,4'-isoproylidenediphenylene diacrylate, 1,3-butylene diacrylate, ethylene diacrylate, ethylidene diacrylate, 1,6-hexamethylene diacrylate, 1,6-hexamethylene dimethacrylate, tetramethylene dimethacrylate, and 2-crotonoyloxyethyl methacrylate. Specific useful polymeric stabilizers that are useful in this invention are poly(styrene-co-n-butyl acrylate-co-2-hydroxyethyl methacrylate-co-methacrylic acid-co-ethylene dimethacrylate), 25/30/15/10/20 weight percent, and poly (styrene-co-2-hydroxyethyl methacrylate-comethacrylic acid-co-ethylene dimethacrylate), 45/30/15/10 weight percent.

The stabilizers are conveniently prepared by conventional aqueous emulsion polymerization processes, although other methods of preparation known to those skilled in the art may also be feasible. In such an emulsion polymerization process, the various monomers necessary to form the desired polymer, together with minor amounts of ingredients such as polymerization initiators, and a surfactant or emulsifying agent are added to water in addition to the monomers. A typical polymerization mixture can include, for example, about 35 to 97% by weight, water. The amount of water, to some extent, determines the size of the polymer particles in that less water tends to result in larger size particles.

A water soluble free radical initiator, typically about 0.1 to 10%, by weight, (based on total monomer weight), and preferably about 0.5 to 5%, is used to initiate the polymerization. Examples of suitable initiators include redox systems comprising persulfates such as potassium persulfate or ammonium persulfate and a bisulfite such as sodium bisulfite or potassium bisulfite. Free radical initiators, e.g., azo compounds such as 4,4'-azobis(4-cyanovaleric acid) 2,2'-azobis(2amidinopropane)hydrochloride or 2,2'-azobis(2-methylpropanesulfonate) and peroxides such as benzoyl peroxide can be used.

The polymerization mixture also typically contains a surface active agent such as sodium dodecyl sulfate, octylphenoxypolyethoxy ethanol, sodium lauryl sulfate sodium stearate and similar materials. Such surface active agents disperse the polymerizable monomers in the aqueous medium and concentrations are normally in the range of about 0.01 to 0.5 parts, by weight, based on polymerization mixture.

In a typical emulsion polymerization process, the water is degassed with an inert gas such as argon or nitrogen, to remove oxygen, and the surfactant and a mixture of the monomers is added to the water. The initiator is added and the mixture is heated at about 80° to 90° C. for about 1 to 3 hours. The polymerization is complete when the monomer concentration, which can be monitored, diminishes to nearly zero. The pH is adjusted to about 7 to facilitate removal of the surfactant and the copolymer particles are stirred with a mixed-bed ion exchange resin which removes surfactant.

The resulting polymers typically have average diameters (swollen, in water) in the range of about 0.01 to 1.0 micrometer, often about 0.01 to 0.15 micrometer. The average diameters are diameters of median particles by volume, as described in U.S. Pat. No. 4,965,131. The polymers are solid colloidal materials that are insoluble but dispersible in water and function as excellent stabilizers for the process of this invention. It is convenient to use them in such processes in the form of aqueous latexes.

The polymeric stabilizers used in this invention perform their function of stabilizing the aqueous suspension of droplets without additional stabilizers. The copolymer is a third phase because it is insoluble in both the aqueous phase and in the suspended droplets. They are also non-dispersible in the droplets, but wettable by the droplets. They are more hydrophilic than oleophilic and more hydrophilic than the droplets, so that they remain at the interface of the aqueous phase and the suspended droplets. The stabilizer particles uniformly cover the surface of the suspended droplets forming a layer on the binder polymer particles formed in the process. This layer provides a surface which covers such particles and provides active sites to react with the hydroxy groups of the polyorganosiloxane oligomer containing pendant charge-control moieties. It is not certain that the polymeric stabilizer particles react with the binder polymer particles to form chemical bonds but, considering the stable nature of the interface between such particles, it is believed that the stabilizer particles are firmly held or adsorbed on the surface of the binder polymer particles due to a strong mutual attraction such as hydrogen bonding. Regardless of the exact mechanism involved, the fact is that such stabilizer particles form a layer on the binder polymer particles which permits the polyorganosiloxane oligomer containing pendant charge-agent moieties to be firmly and permanently affixed to such particles. This provides a method that is direct, efficient and cost effective for obtaining electrostatographic toners.

Another essential feature of this invention is the use of a polyorganosiloxane oligomer containing a plurality of hydroxy groups and pendant charge-control moieties. As previously indicated herein, such hydroxy groups react with the bonding sites provided by the stabilizer particles on the binder polymer particles to incorporate the pendant charge-control moieties into the binder. As a result of such reaction, the charge-control moieties are firmly and covalently bonded to the binder polymer particles through a plurality of very stable oxygen linkages (carbon-oxygen-silicon) between the polymer stabilizer particles and the polyorganosiloxane oligomer. Accordingly, the charge-control moieties are firmly bonded to the surface of the binder polymer particles and do not migrate within, or exude from, the electrostatographic toner over time. This results in a very consistent and stable toner charge and permits a very uniform dispersion of the charge-control moieties over the toner binder particles. In this regard, we have found that polymeric beads formed by reaction between polymeric stabilizer particles and polyorganosiloxane oligomers containing a plurality of hydroxy groups and pendant charge-control moieties can be added to electrostatographic toners to form a discontinuous layer of beads on the toner binder polymer which provides some degree of charge-control. However, this technique provides significantly inferior charge-control and developer life in comparison to that which is achieved by the practice of this invention.

Charge-control moieties that can be present in the polyorganosiloxane oligomers include any of the charge-control moieties that are familiar to those skilled in the art. They can be negatively or positively charging and include moieties that are onium moieties such as ammonium, phosphonium, and arsonium moieties as well as fluorinated hydrocarbyls such as fluoroalkyl.

Very useful moieties are onium moieties represented by the following formula:

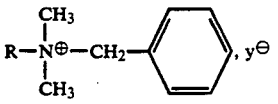

where

R is alkylene containing 12–18 carbon atoms and a linkage to the siloxane oligomer, and y is an anion. Compounds that can provide moieties of this type include, for example, benzyldimethloctadecylammonium chloride, benzyldimethyloctadecylammonium 3-nitrobenzene sulfonate and benzyldimethyloctadecylammonium p-toluenesulfonate.

Polyorganosiloxane oligomers having the desired hydroxy groups and charge-agent moieties are available in the prior art or can be synthesized by known techniques. For example, they can be prepared by acid-catalyzed hydrolysis and polycondensation of organosilanes such as dialkoxydialkylsilanes or trialkoxyalkylsilanes where at least one alkyl group in the silane contains a charge-agent moiety. Hydrolysis of such silanes can generally be performed at room temperature and provides corresponding silanols which undergo condensation to form siloxane linkages. An advantage of such a synthesis is that the nature and number of the alkyl groups can be used to define the polarity and concentration of the charge on the resulting polyorganosiloxane oligomer. Some specific silanes that can be used in the aforementioned synthesis include those represented by the following formula:

$$(RO)_3\,SiR$$

where each RO is alkoxy such as methoxy, ethoxy and pentoxy and R is alkyl containing a charge-agent moiety such as triphenyl phosphonium bromide, triphenyl phosphonium toslylate, triphenyl phosphonium tetraphenyl borate; methyl, octyl and benzyl ammonium tosylate; methyl, octyl and benzyl ammonium chloride or methyl, octyl and benzyl ammonium m-nitrobenzene sulfonate. Specific examples of suitable silanes include octadecyldimethyl [3-(trimethoxysilyl)-propyl]ammonium silane chloride and tridecafluoro-1,1,2,2-tetrahydrooctyl -1-triethoxy silane.

Some useful polyorganosiloxane oligomers for use in this invention can be represented by the following general formula:

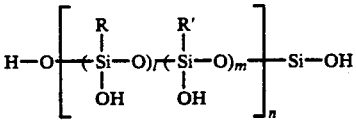

where each R is an aliphatic group containing at least one onium charge-control moiety, each R′ is hydrocarbon, and 1, m and n are positive integers such that 1+m+n provides a number average molecular weight (Mn) in the range of about 250 to 2500, often about 500 to 1500. Specific examples of useful polyorganosiloxane oligomers are poly {Si-[3 -30 (N,N-dimethyl-N-octadecyl ammonio) propyl]-Si-hydroxy silane chloride} and poly [Si-(tridecalfuoro-1,1,2,2-tetrahydroxy)-Si-hydroxy siloxane].

Reaction between the active sites in the polymeric stabilizer particles and the hydroxy groups in the polyorganosiloxane oligomer can be achieved using conventional techniques known to those skilled in the art such as acid-catalyzed polycondensation at temperatures in the range of about 15° C. to 50° C. The binder polymer particles coated with stabilizer particles can be removed from the reaction medium in which they are prepared by limited coalescence, suspended in an aqueous medium and reacted with the polyorganosiloxane oligomer in the suspension, as described in the Examples hereinafter. Alternatively, the polyorganosiloxane oligomer can be added to the reaction medium containing the binder polymer particles coated with stabilizer particles to achieve in situ modification of such particles. The former procedure offers an advantage over the latter in that a master batch of the stabilizer coated binder polymer particles can be prepared and then portions of that batch modified with polyorganosiloxane oligomer containing different charge-control moieties or different concentrations of such moieties. Accordingly, a single master batch of binder polymer particles can provide several desired toner variations.

Useful solvents for the limited coalescence process of this invention are those that dissolve the binder polymer and which are also immiscible with water including, for example, chloromethane, dichloromethane, ethyl acetate vinyl chloride, methyl ethyl ketone trichloromethane, carbon tetrachloride, ethylene chloride, trichloroethane, toluene, xylene, cyclohexanone and 2-nitropropane.

It has generally been found that the ratio of the binder polymer to the solvent should vary in an amount of from about 1 to 80%, by weight of combined weight of polymer and solvent and that the combined weight of the polymer and the solvent should vary with respect to the quantity of water employed in an amount of from about 25 to 50%, by weight. Also, the size and quantity of the solid polymeric stabilizer depends upon the size of the particles of the stabilizer and also upon the size of the binder polymer particles desired. Thus, as the size of the polymer/solvent droplets are made smaller by high shear agitation, the quantity of solid polymeric stabilizer is varied to prevent uncontrolled coalescence of the droplets and to achieve uniform size and narrow size distribution in the binder polymer particles that result.

Binder polymer particles having average diameters in the range of about 0.1 micrometer to 150 micrometers, often from about 2 micrometers to 30 micrometers, can be prepared in accordance with the process of this invention. Such particles have a very narrow size distribution. Their coefficients of variation (ratio of the standard deviation to the average diameter), as indicated in U.S. Pat. No. 4,965,131, are normally in the range of about 15 to 35%

The polymers initially prepared by the limited coalescence process of this invention are those known to be useful in electrostatographic toners. As previously indicated herein, the vinyl addition polymers and polyesters are useful classes of binder polymers. Specific examples of useful polymers include, for example, olefin homopolymers and copolymers, such as polyethylene, polypropylene, polyisobutylene, and polyisopentylene; polyfluoroolefins such as polytetrafluoroethylene; polyhexamethylene adipamide, polyhexamethylene sebacamide and polycaprolactam; acrylic resins, such as polymethylmethacrylate, polyacrylonitrile, polymethylacrylate, polyethylmethacrylate and styrene-methymethacrylate or ethylene-methyl acrylate copolymers, ethylene-ethyl acrylate copolymers, ethylene-ethyl methacrylate copolymers, polystyrene and copolymers of styrene with unsaturated monomers mentioned above, cellulose derivatives, such as cellulose acetate, cellulose acetate butyrate, cellulose propionate, cellulose acetate propionate, and ethyl cellulose; polyvinyl resins such as polyvinyl chloride, copolymers of vinyl chloride and vinyl acetate and polyvinyl butyral, polyvinyl alcohol, polyvinyl acetal, ethylene-vinyl acetate copolymers, and ethylene-allyl copolymers such as ethylene-allyl alcohol copolymers, ethylene-allyl acetone copolymers, ethylene-allyl benzene copolymers ethylene-allyl ether copolymers, ehtylene-acrylic copolymers and polyoxymethylene, polycondensation polymers, such as, polyesters, polyurethanes, polyamides and polycarbonates.

Preferred binder polymers modified to include charge-agent moieties according to this invention (sometimes referred to hereinafter for convenience simply as binder/charge-control polymers) are amorphous polymers having a glass transition temperature (referred to as Tg) in the range of about 40° to 150° C., and more preferably about 50° to 120° C. Such polymers can be heat-fixed to smooth-surfaced film substrates as well as to more conventional substrates, such as paper, without difficulty. Tg can be determined by any conventional method, e.g., differential scanning calorimetry. Preferred electrostatographic toner embodiments contain binder/charge-control polymers having inherent viscosities in the range of about 0.01 to about 0.65 deciliters per gram (dl/g), as measured at 25° C. and at a concentration of 2.5 g/1 in a solution of dichloromethane (DCM), dimethylformamide (DMF), or a 1:1 by weight mix of phenol:chlorobenzene (P:CB).

To perform the charge-control function in an inventive electrostatographic toner the binder/charge-control polymer will usually be included in the toner in an amount sufficient to yield a concentration of individual charge-agent moieties in the range of about $10^{-9}$ to about $10^{-4}$ moles of charge-agent moieties per gram of all material in the toner particle. The exact concentration employed will depend on the level of charge desired and the triboelectric nature of the binder/charge-control polymer and all other materials in the inventive toner particle (and also the triboelectric nature of the carrier particles, if toner particles are intended to be mixed with carrier particles to form an inventive so-called "two-component" electrostatographic developer). The binder/charge-control polymers can also be used in toners intended to be used by themselves (i.e., with no carrier particles) as a so-called "single component" electrostatographic developer.

It should be appreciated that the desired concentration of charge agent moieties in the inventive toner can be effected in more than one manner. In cases where a toner particle consists of only the binder/charge-control polymer, the moles of charge agent moieties per gram of toner particle will be equal to the moles of charge-agent moieties or units per gram of polymer. In cases where other materials (e.g., other binders, colorants, release agents, etc.) are additionally included in the inventive toner particle, the moles of charge-agent moieties per gram of polymer must be higher than the moles of such moieties per gram of toner particle to compensate for the additional weight of other materials in the particle. Thus, binder/charge-control polymer useful in inventive toner particles, include not only those in which charge agent-containing units are included in a concentration range of $10^{-9}$ to $10^{-4}$ moles per gram of polymer, but also others in which the concentration of charge-agent containing units is considerably higher than that range.

As noted above, the inventive toner can additionally contain other materials, such as other binders, colorants, and release agents.

Other binders which can be mixed with the binder/charge-control polymers of this invention in inventive toner include any of the polymers known to be useful as toner binders. Among such other polymeric binders are polyesters (including polycarbonates), polyamides, phenol-formaldehyde polymers, polyesteramides, alkyd resins, and vinyl-addition polymers and copolymers, typically formed from monomers such as styrenes, butadiene, acrylates and methacrylates, among others. For further descriptions of some of these other polymeric binders, see, for example, U.S. Pat. Nos. 3,809,554; Re 31,072; 3,694,359; 2,917,460; 2,788,288; 2,638,416; 2,618,552; 4,416,965; 4,691,966; and 2,659,670.

Numerous colorant materials selected from dyestuffs or pigments can be employed in the toner of the invention. Such materials serve to color the toner and/or render it more visible. Of course, suitable toner materials having the appropriate charging characteristics can be prepared without the use of a colorant material where it is desired to have a developed image of low optical density. In those instances where it is desired to utilize a colorant, the colorants can, in principle, be selected from virtually any of the compounds mentioned in the Colour Index Volumes 1 and 2, Second Edition. Included among the vast number of useful colorants are such materials as Hansa Yellow G (C.I. 11680), Nigrosine Spirit soluble (C.I. 50415), Chromogen Black ETOO (C.I. 45170), Solvent Black 3 (C.I. 26150), Fuchsine N (C.I. 42510), C.I. Basic Blue 9 (C.I. 52015). Carbon black also provides a useful colorant. The amount of colorant added may vary over a wide range, for example, from about 1 to 20 percent of the weight of binder polymer. Particularly good results are obtained when the amount is from about 1 to 10 percent.

To utilize a binder/charge-control polymer in the inventive electrostatographic toners, the polymer particles are mixed in any convenient manner with any other desired addenda, to form a free-flowing powder of inventive toner particles containing the binder/charge control polymer.

When utilized as toners in electrostatographic developers of the invention, toner particles can be mixed with a carrier vehicle. The carrier vehicles which can be used to form such inventive developer compositions can be selected from various materials. Such materials include carrier core particles and core particles overcoated with a thin layer of film-forming resin.

The carrier core materials can comprise conductive, non-conductive, magnetic, or non-magnetic materials. For example, carrier cores can comprise glass beads; crystals of inorganic salts such as aluminum potassium chloride; other salts such as ammonium chloride or sodium nitrate; granular zircon; granular silicon; silicon dioxide; hard resin particles such as poly(methyl methacrylate); metallic materials such as iron, steel, nickel, carborundum, cobalt, oxidized iron; or mixtures or alloys of any of the foregoing. See, for example, U.S. Pat. Nos. 3,850,663 and 3,970,571. Especially useful in magnetic brush development schemes are iron particles such as porous iron particles having oxidized surfaces, steel particles, and other "hard" or "soft" ferromagnetic materials such as gamma ferric oxides or ferrites, such as ferrites of barium, strontium, lead, magnesium, or aluminum. See, for example, U.S. Pat. Nos. 4,042,518; 4,478,925; and 4,546,060.

As noted above, the carrier particles can be overcoated with a thin layer of a film-forming resin for the purpose of establishing the correct tribo-electric relationship and charge level with the toner employed. Examples of suitable resins are the polymers described in U.S. Pat. Nos. 3,547,822; 3,632,512; 3,795,618 and 3,898,170 and Belgian Patent No. 97,132. Other useful resins are fluorocarbons such as polytetrafluoroethylene, poly(vinylidene fluoride), mixtures of these, and copolymers of vinylidene fluoride and tetrafluoroethylene. See, for example, U.S. Pat. Nos. 4,545,060; 4,478,925; 4,076,857; and 3,970,571. Such polymeric fluorohydrocarbon carrier coatings can serve a number of known purposes. One such purpose can be to aid the inventive developer to meet the electrostatic force requirements mentioned previously by shifting the carrier particles to a position in the triboelectric series different from that of the uncoated carrier core material, in order to adjust the degree of triboelectric charging of both the carrier and toner particles. Another purpose can be to reduce the frictional characteristics of the carrier particles in order to improve developer flow properties. Still another purpose can be to reduce the surface hardness of the carrier particles so that they are less likely to break apart during use and less likely to abrade surfaces (e.g., photoconductive element surfaces) that they contact during use. Yet another purpose can be to reduce the tendency of toner material or other developer additives to become undesirably permanently adhered to carrier surfaces during developer use (often referred to as scumming). A further purpose can be to alter the electrical resistance of the carrier particles.

A typical developer composition of the invention containing inventive toner particles and a carrier vehicle generally comprises from about 1 to 20 percent by weight of the toner particles and from about 80 to 99 percent by weight carrier particles. Usually, the carrier particles are larger than the toner particles. Conventional carrier particles have a particle size on the order of from about 2 to about 1200 microns, preferably 5–300 microns. Alternatively, toners of the present invention can be used in a single component developer, i.e., with no carrier particles.

Toner and developer compositions of this invention can be used in a variety of ways to develop electrostatic charge patterns or latent images. Such developable charge patterns can be prepared by a number of means and be carried for example, on a light sensitive photoconductive element or a non-light-sensitive dielectric-surfaced element such as an insulator-coated conductive sheet. One suitable development technique involves cascading the developer composition across the electrostatic charge pattern, while another technique involves applying toner particles from a magnetic brush. This latter technique involves the use of a magnetically attractable carrier vehicle in forming the developer composition. After image wise deposition of the toner particles, the image can be fixed, e.g., by heating the toner to cause it to fuse to the substrate carrying the toner. If desired, the unfused image can be transferred to a receiver such as a blank sheet of copy paper and then fused to form a permanent image.

The following preparation techniques and examples are presented to further illustrate some preferred embodiments of this invention.

In some of the preparations and examples polymer names contain an indication of the molar or weight ratios of the various units in the polymer, as specified. In some of the preparations and examples (as indicated therein) the relative concentrations of units are expressed as ratios or amounts of the monomers used to prepare the polymer.

Where toner charge in a developer is indicated, usually as microcoulombs per gram of toner particles μc/g), the charge was determined by a technique referred to as the "MECCA" method, wherein the apparatus consists of two parallel metal plates separated by insulating posts about 1 cm high. An AC electromagnet is located beneath the lower plate to provide magnetic agitation, while a DC electric potential of about 2000 volts can be applied across the plates. A sample of about 0.2 gram of developer is weighed, placed on the lower plate, and charged by magnetic agitation for 30 seconds. Next, both the electric and magnetic fields are applied for 30 seconds. The toner is separated from the carrier by the combined agitation and electric field and is transported to the upper plate by the electric field. The charge on the toner collected by the top plate is measured in microcoulombs by an electrometer, and the weight of toner is determined. The registered charge is divided by the weight of the plated toner to obtain the charge per mass of toner. The developer is treated under two different conditions;

(1) fresh developer: the developer is prepared at an initial toner concentration of 5 weight per cent and tested without prior use.

(2) exercised developer: before testing, the developer, at 5 weight per cent toner concentration, is exercised for 5 minutes by tumbling in a glass bottle placed in the rotating magnetic field (2000 rpm) of a magnetic brush developing station.

Developer dusting or "throw-off", reported in milligrams, is performed with fresh developer formed by mixing toner particles with strontium ferrite carrier particles thinly coated with fluorocarbon resin. In making the test, a four gram sample of developer is placed in a magnetic brush developer station which is connected by way of a filter to a vacuum source. As the magnets of the brush rotate and agitate the developer, toner which separates from the carrier is drawn off by the vacuum and collects on the filter. The weight of toner on the filter after one minute shows the extent of dusting or "throw-off" of toner.

PREPARATION I: POLYMERIC STABILIZER

The polymerization method employed was a conventional emulsion polymerization using an aqueous medium containing an emulsifying agent in a water soluble free radical initiator.

4.5 g (0.016 mole) of sodium dodecyl sulfate was added to a mechanically stirred 5 liter vessel containing 2000 milliliters of water. The solution was degassed with argon for 1 hour. Concurrently a 250 milliliter vessel containing 20.4 g. (0.196 mole) styrene, 16.8 g (0.131 mole) n-butyl acrylate, 18 g (0.138 mole) 2-hydroxy ethyl methacrylate, 3 g (0.035 mole) methylacrylic acid and 1.8 g (0.009 mole) ethylene dimethacrylate was purged with argon for 5 minutes to form a monomer solution.

The aqueous phase was heated to 90° C. and the monomer solution was then added with rapid stirring (325 rpm). Stirring was continued for 5 minutes and 0.026 g (0.001 mole) of ammonium persulfate was added. The polymerization was run at 90° C. for 14 hours. The resulting mixture was cooled to room temperature and filtered and the pH was adjusted to 7 using 0.01N potassium hydroxide. The suspension obtained was stirred with a mixed bed ion exchange resin (Amberlite MB-1 sold by Rohm and Haas) for 1 hour, filtered and then diafiltered using a 1000 molecular weight cut off polysulphone membrane until all the surfactant was removed. The average diameter of the resulting polymeric stabilizer particles in water was 0.06 micrometer at pH 10. For convenience, the latex of polymer in water was used as the stabilizer without isolation of the polymer.

PREPARATION II: POLYORGANOSILOXANE OLIGOMER

This preparation illustrates the manufacture of the polyorganosiloxane oligomer employed in the following example.

A polysiloxane oligomer was prepared from octadecyldimethyl [3-(trimethoxysilyl)propyl] ammonium silane chloride, having the formula:

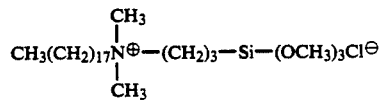

using the following procedure: 0.5 g of the silane (50 percent, by weight, in methanol) and 50 mls of water were placed in a vessel. Two droplets of glacial acetic acid were stirred in at 20° C. for fifteen minutes to adjust the pH to 6.5. The silane was then cured by stirring for 10 mins. at 20° C. to provide poly (Si-[3-(N,N dimethyl-N-octadecyl ammonio)propyl]-Si-hydroxy siloxane chloride} having a number average molecular weight (Mn) of 1000 and contains the ammonium charge control moieties of. Structure was confirmed by GPC, NMR and IR spectroscopy. For convenience, the aqueous solution of polymer is used in the following Examples to form the binder/charge-control polymer agent particles.

EXAMPLE 1

Electrostatographic toner and developer prepared according to this invention exhibit good charging properties and form stable developers having exceptionally long developer life.

To illustrate, a mixture of 46 g poly (glycerol-co-1,2-propanediol-co-glutarate-coterephthalate) of, molar ratios 45/5/37/13, respectively having an inherent viscosity of 0.4 dl/g in dichloromethane and a Tg of 62° C.; 8 percent, by weight, of a red pigment and 0.2 percent, by weight, of benzyldimethyloctadecylammonium chloride, a charge control agent, were dissolved in 200 g of ethyl acetate. The solution was then dispersed in 750 mls. of a borate buffer (pH8) and 50 mls of a latex of Preparation I (2.98 percent solids). The resulting dispersion was homogenized in a high shear mixer, sized and stirred for fourteen hours under a nitrogen sweep. Residual ethyl acetate was removed from the resulting particles under vacuum. The particles were collected and washed with distilled water until a neutral pH of 7 was reached. The particles were then dried at a temperature of 38° C. for twelve hours and classified to provide particles having an average particle diameter of 5 micrometer in a particle range of 2.8 to 7.2 micrometer. These particles comprised a core of the polyester coated with a layer of smaller polymeric stabilizer particles of copoly (styrene-co-n-butyl acrylate-co-2-hydroxyethyl methacrylate-co-methacrylic acid-co-ethylene dimethacrylate), 25/30/15/10.20, weight percent. The 2-hydroxyethyl methacrylate and methacrylic acid components of this copolymer provide a plurality of active sites for reaction with a polyorganosiloxane oligomer.

25 g of the coated polyester particles were placed in a vessel containing 100 mls of water and stirred 10 mins. 50 mls of an aqueous solution of Preparation II was added and stirring was continued for 10 mins. The solid toner particles obtained were filtered, washed with water and dried for fourteen hours at 38° C. The particles comprised a layer of the poly (octadecyldimethyl-3-propyl ammonium) siloxane chloride particles covalently bonded to the polyester binder core through multiple oxygen linkages between the polysiloxane particles and polymeric stabilizer particles.

The toner particles were then mixed with carrier particles by agitating in vessel at 20° C. for 2 mins. to form an inventive triboelectrically charged two-component dry electrostatographic developer comprising about 6–12 weight percent toner particles depending upon particle size. The carrier particles used were strontium ferrite particles having an average particle size of 30–40 micrometers coated with one part per hundred by weight of a thin poly (vinylidene fluoride) film. The triboelectric charge per mass of toner particles was measured and reported in the following Table.

For comparison purposes, a control two-component dry electrostatographic developer was prepared according to the procedure of this Example I with the polyester particles coated with smaller polymeric stabilizer particles but which were not further treated with the polyorganosiloxane oligomer. It should be noted that such particles did contain 0.2 weight percent of benzyldimethyl-octadecylammonium chloride, a known charge-control agent.

TABLE I

| Developer | Toner Charge (μc/g) Fresh | Exercised | Toner Throw-Off (mg.) |
|---|---|---|---|
| Control | 7.1 | 0 | 1 |
| Invention | 179.3 | 173.8 | 0.2 |

The above results clearly demonstrate that the toner throw-off is substantially less when the toner particles are coated with the layer of polyorganosiloxane oligomer according to the practice of this invention. This indicates that the toner will maintain a stable electrostatographic charge during the development process and will not be lost to the system. Also, the charge to mass ratios reported in the above Table I illustrate that the inventive developers initially charge to a higher level and show very little change (approximately three percent) in the charge after exercise, in comparison to the Control.

The inventive electrostatographic developer was used in bias development tests carried out in a laboratory electrophotographic copying apparatus having an organic photoconductor film, a magnetic brush developing station and a biased roll transfer station for transferring the toner image from the photoconductor film to sheets of bond paper. Samples of developer (5 to 15 g of toner taken out per hour) were measured at various times for charge to mass ratio and throw-off. After more than 20 hours of development the image produced continued to be very sharp and the toner exhibited excellent transfer properties. The charge to mass ratio and throw-off measurements showed no unacceptable change. These results demonstrate that the inventive electrostatographic developer has exceptional developer life.

Similar results can be achieved when the procedure of this Example I is repeated with poly[Si-(tridecafluoro-1,1,2,2-tetrahydroxyoctyl)-Si-hydroxy siloxane], a negatively charging polyorganosiloxane oligomer prepared from a monomer having the formula:

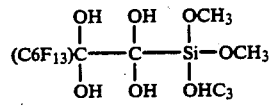

EXAMPLE 2

A mixture of 15 g of poly (decamethylene sebacate), (molar ratios 90/10/, respectively) having an inherent viscosity of 0.3 dl/g in dichloromethane and a Tm of 74° C.; 30 percent, by weight, of an aluminum pigment and 10%, by weight of a surfactant were dissolved in 100 g of dichloromethane. The solution was then dispersed in 375 mls. of a buffer (pH10) and 6.5 mls of a latex of Preparation I (5.3 percent solids). The resulting dispersion was homogenized in a high shear mixer, sized and stirred for fourteen hours under a nitrogen sweep. Residual dichloromethane was removed from the resulting particles under vacuum. The particles were collected and washed with distilled water until a neutral pH of 7 was reached. The particles were then dried at a temperature of 38° C. for twelve hours and classified to provide particles having an average particle diameter of 5.8 micrometer in a particle range of 2.8 to 8.7 micrometer. These particles comprised a core of polyester coated with a layer of smaller polymeric stabilizer particles of copoly (styrene-co-n-butyl acrylate-co-2-hydroxyethyl methacrylate-comethacrylic acid-co-ethylene dimethacrylate), 25/30/15/10.20, weight percent. The 2-hydroxyethyl methacrylate and methacrylic acid components of this copolymer provide a plurality of active sites for reaction with a polyorganosiloxane oligomer.

10 g of the coated polymer particles were placed in a vessel containing 100 mls of water and stirred 20 mins. 20 mls of an aqueous solution of Preparation II was added and stirring was continued for 5 mins. The solid toner particles obtained were filtered, washed with water and dried for fourteen hours at 38° C. The particles comprised a layer of the poly (octadecyldimethyl-3-propyl ammonium) siloxane chloride particles covalently bonded to the poly (decamethylene sebacate) binder core through multiple oxygen linkages between the polysiloxane particles and polymeric stabilizer particles.

The toner particles were then mixed with carrier particles by agitating in a vessel at 20° C. for 2 mins. to form an inventive triboelectrically charged two-component dry electrostatographic developer comprising about 6–12 weight percent toner particles. The carrier particles used were strontium ferrite particles having an average particle size of 30–40 micrometers coated with one part per hundred by weight of a thin poly (vinylidene fluoride) film. The triboelectric charge per mass of toner particles was measured and reported in the following Table 2.

For comparison purposes, a control two-component dry electrostatographic developer was prepared according to the procedure of this Example I with the poly (decamethylene sebacate) particles coated with smaller polymeric stabilizer particles but which were not further treated with the polyorganosiloxane oligomer. It should be noted that such particles did contain 0.2 weight percent of benzyldimethyloctadecylammonium chloride, a known charge-control agent.

TABLE 2

| Developer | Toner Charge (μc/g) Fresh | Exercised | Toner Throw-Off (mg.) |
|---|---|---|---|
| Control | 7.5 | 0 | 3 |
| Invention | 29.6 | 29.3 | 1.8 |

The toner throw-off values reported in the above Table 2 demonstrate that the toner will maintain a stable electrostatographic charge during the development process and will not be lost to the system. Also, the charge to mass ratios reported in the above Table I illustrate that the inventive developers show substantially no change in the charge after exercise. Also, when the inventive developer was used in bias development tests according to the procedure of Example I; the charge to mass ratio and throw-off values showed no unacceptable change.

EXAMPLE 3

A mixture of 94 g of poly (styrene-co-n-butyl acrylate) 75/25, weight percent, having an inherent viscosity of 0.4 dl/g in dichloromethane and a Tg of 48° C.; 12 percent, by weight, of a pigment, and 0.2 percent, by weight, of benzyldiemthyloctadecylammonium chloride, a charge control agent, were dissolved in 376 g of ethyl acetate. The solution was then dispersed in 1410 mls. of a buffer (pH10) and 109.9 mls of a latex of Preparation I (2.98 percent solids). The resulting dispersion was homogenized in a high shear mixer, sized and stirred for fourteen hours under a nitrogen sweep. Residual ethyl acetate was removed from the resulting particles under vacuum. The particles were collected and washed with distilled water until a neutral pH of 7 was reached. The particles were then dried at a temperature of 38° C. for twelve hours and classified to provide particles having an average particle diameter of 14.5 micrometer in a particle range of 14 to 15 micrometer. These particles comprised a core of poly (styrene-co-n-butylacrylate) coated with a layer of smaller polymeric stabilizer particles of copoly (styrene-co-n-butyl acrylate-co-2-hydroxyethyl methacrylate-co-methacrylic acid-co-ethylene dimethacrylate), 25/30/15/10.20, weight percent. The 2-hydroxyethyl methacrylate and methacrylic acid components of this copolymer provide a plurality of active sites for reaction with a polyorganosiloxane oligomer.

50 g of the coated polymer particles were placed in a vessel containing 200 mls of water and stirred 20 mins. 25 mls of an aqueous solution of Preparation II was added and stirring was continued for 10 mins. The solid toner particles obtained were filtered, washed with water and dried for fourteen hours at 38° C. The particles comprised a layer of the poly (octadecyldimethyl-3-propyl ammonium) siloxane chloride particles covalently bonded to the binder polymer core through multiple oxygen linkages between the polysiloxane particles and polymeric stabilizer particles.

The toner particles were then mixed with carrier particles by agitating in a vessel at 20° C. for 2 mins. to form an inventive triboelectrically charged two-component dry electrostatographic developer comprising about 6–12 weight percent toner particles. The carrier particles used were strontium ferrite particles having an average particle size of 30–40 micrometers coated with one part per hundred by weight of a thin poly (vinylidene fluoride) film. The triboelectric charge per mass of toner particles was measured and reported in the following Table 3.

For comparison purposes, a control two-component dry electrostatographic developer was prepared according to the procedure of this Example I with the poly (styrene-co-n-butylacrylate) particles coated with smaller polymeric stabilizer particles but which were not further treated with the polyorganosiloxane oligomer. It should be noted that such particles did contain 0.2 weight percent of benzyldimethyl-octadecylammonium chloride, a known charge-control agent.

TABLE 3

| Developer | Toner Charge (μc/g) Fresh | Exercised | Toner Throw-Off (mg.) |
|---|---|---|---|
| Control | 9 | 0 | 3 |
| Invention | 169.2 | 170.2 | 2.9 |

The charge to mass ratios reported in the above Table 3 illustrate that the inventive developers maintain a very stable charge coupled with the low throw-off reported. In addition, when the inventive electrostatographic developer was used in bias development tests as in Example I no unacceptable change in charge to mass ratios or throw-off occurred.

The invention has been described in detail with particular reference to certain preferred embodiments thereof, but it should be appreciated that variations and modifications can be effected within the spirit and scope of the invention.

What is claimed is:

1. An electrostatographic toner comprising binder polymer particles and charge-control moieties, the improvement wherein the binder polymer particles have a surface layer of smaller polymeric particles that are covalently bonded through a plurality of oxygen linkages to polyorganoxiloxane oligomer containing pendant charge-control moieties.

2. The electrostatographic toner of claim 1 wherein the charge-control moieties are onium moieties.

3. The electrostatographic toner of claim 2 wherein the onium moieties are ammonium moieties.

4. The electrostatographic toner of claim 2 wherein the onium moieties are phosphonium moieties.

5. The electrostatographic toner of claim 1 wherein the binder polymer particles have an average diameter in the range of about 0.1 to 150 micrometers and the smaller polymeric particles have an average diameter in the range of about 0.01 to 1 micrometer.

6. In a dry electrostatographic developer comprising (a) carrier particles and (b) toner particles, the improvement wherein the toner particles are particles of toner as defined in claim 1.

7. In a dry electrostatic developer comprising (a) carrier particles and (b) toner particles, the improvement wherein the toner particles are particles of toner as defined in claim 5.

* * * * *